US011141339B1

(12) United States Patent
Henderson

(10) Patent No.: US 11,141,339 B1
(45) Date of Patent: Oct. 12, 2021

(54) CASKET LID

(71) Applicant: Edward C. Henderson, Skokie, IL (US)

(72) Inventor: Edward C. Henderson, Skokie, IL (US)

( * ) Notice: Subject to any disclaimer, the term of this patent is extended or adjusted under 35 U.S.C. 154(b) by 0 days.

(21) Appl. No.: 15/444,300

(22) Filed: Feb. 27, 2017

(51) Int. Cl.
*A61G 17/02* (2006.01)

(52) U.S. Cl.
CPC ..... *A61G 17/02* (2013.01)

(58) Field of Classification Search
CPC .. A61G 17/02; A61G 17/004; A61G 17/0073; A61G 17/0106; B65D 43/00; B65D 9/32
USPC ..... 27/2, 4, 14; 217/56
See application file for complete search history.

(56) References Cited

U.S. PATENT DOCUMENTS 338,607 A * 3/1886 Morris ..... E05C 19/06 292/303
1,192,169 A 7/1916 Camp
2,044,872 A 6/1936 Beatty
2,056,404 A 10/1936 Lawrence
2,111,337 A 3/1938 Sherman
2,318,353 A 5/1943 Allshouse et al.
2,327,949 A 8/1943 West
3,810,281 A 5/1974 Ferber
4,170,054 A 10/1979 Ruffner et al.
4,773,134 A 9/1988 Kay
4,967,455 A * 11/1990 Elder ..... A61G 17/00 27/14
5,495,648 A 3/1996 Rojdev et al.
5,634,247 A 6/1997 Bowling
5,709,016 A * 1/1998 Gulick ..... A61G 17/00 27/14
5,727,291 A * 3/1998 Biondo ..... A61G 17/04 27/1
5,740,592 A 4/1998 Lau
5,815,898 A 10/1998 Jenkins
D416,659 S 11/1999 Jeffers
D417,057 S 11/1999 Jeffers
6,094,789 A * 8/2000 Hankel ..... A61G 17/007 27/10
6,317,943 B1 11/2001 Wood
D512,194 S 11/2005 Draeger
7,003,855 B2 * 2/2006 Lew ..... A61G 17/00 27/14

(Continued)

FOREIGN PATENT DOCUMENTS

JP 2002-209959 A 7/2002

OTHER PUBLICATIONS

Int'l Search Report for PCT/US 18/19971, filed Feb. 27, 2018, Applicant Henderson, ISR dated Jun. 27, 2018; 2 pp.

(Continued)

*Primary Examiner* — William L Miller
(74) *Attorney, Agent, or Firm* — Robert S. Smith

(57) ABSTRACT

In one example, the present invention relates to a casket lid having two long sides and two short sides, including an internal support system and an external face, wherein (i) the internal support system comprises three layers that are each co-extensive with each of the long sides and short sides, (ii) the first layer and the third layer are each in contact with the second layer, and (iii) each of said layers is in contact with the external face on each of said long sides and said short sides.

20 Claims, 6 Drawing Sheets

(56) References Cited

U.S. PATENT DOCUMENTS

| | | | | |
|---|---|---|---|---|
| 7,249,402 | B2 | 7/2007 | Davis et al. | |
| 7,302,743 | B2 | 12/2007 | Fash | |
| 7,380,316 | B1 * | 6/2008 | Sauder | A61G 17/02 27/14 |
| 7,434,298 | B2 | 10/2008 | De La Fuente | |
| 7,448,117 | B1 | 11/2008 | Sauder et al. | |
| 7,478,462 | B2 | 1/2009 | Robert et al. | |
| 7,594,306 | B2 * | 9/2009 | Beaulne | A61G 17/00 27/14 |
| D641,945 | S | 7/2011 | Henderson | |
| 8,601,653 | B1 | 12/2013 | Agurcia et al. | |
| 9,050,234 | B2 | 6/2015 | Cox et al. | |
| 2005/0108863 | A1 | 5/2005 | Fash | |
| 2005/0125974 | A1 | 6/2005 | Ozbun | |
| 2010/0313396 | A1 * | 12/2010 | Cox | A61G 17/02 27/14 |
| 2013/0067705 | A1 | 3/2013 | Williamson | |

OTHER PUBLICATIONS

Written Opinion for PCT/US 18/19971, filed Feb. 27, 2018, Applicant Henderson, Written Opinion dated Jun. 27, 2018; 5 pp.

* cited by examiner

CASKET LID

BACKGROUND OF THE INVENTION

The field of the present invention relates generally to methods of carpentry, particularly as applied to the manufacture of casket lids.

Caskets are, of course, used in the ultimate acts of one's life cycle: the putting to rest a decedent. Finely woodworked caskets may provide comfort to the family and friends of a decedent. But little comfort is to be gained in the event that the woodworked casket displays faults in its workmanship, in its underlying support holding the boards facing viewers in place. The present invention provides materials and methods for a finely woodworked casket lid with methodology for eliminating the prospect of separation of the woodworked casket lid.

SUMMARY OF THE INVENTION

One embodiment provides a casket lid having two long sides and two short sides, including an internal support system and an external face, wherein (i) the internal support system comprises three layers that are each co-extensive with each of the long sides and short sides, (ii) the first layer and the third layer are each in contact with the second layer, and (iii) each of said layers is in contact with the external face on each of said long sides and said short sides.

Another embodiment provides the casket lid, wherein the first layer is not in contact with the third layer.

Another embodiment provides the casket lid, wherein each layer includes four right angles formed by four boards of each said layer that are joined by a butt joint or a picture joint.

Another embodiment provides the casket lid, wherein the three layers utilize both a butt joint and a picture joint.

Another embodiment provides the casket lid, wherein each layer utilizes a butt joint or a picture joint but not both.

Another embodiment provides the casket lid, wherein the second layer utilizes a butt joint.

Another embodiment provides the casket lid, wherein the layers that are in contact are joined by a connecting means selected from the group consisting of glue, a peg, a nail, a screw, a rivet, and a strap.

Another embodiment provides the casket lid, wherein the layers are joined by a combination of glue and a peg.

Another embodiment provides the casket lid, wherein the external face is comprised of one or more side boards that are joined by glue.

Another embodiment provides the casket lid, wherein the side boards are further joined by peg or nail.

Another embodiment provides the casket lid, wherein the external face is comprised of a top board that contacts a side board.

Another embodiment provides the casket lid, wherein the top board is joined to an adjacent board or boards by glue.

Another embodiment provides the casket lid, wherein the top board is rounded.

Another embodiment provides the casket lid, wherein the top board is flat.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

In one example, the present invention comprises a casket lid having two long sides and two short sides.

The casket lid includes an underlying support structure that maintains the integrity of the lid.

Described herein are details of the casket lid relating to the series of boards employed to assemble the product as well as a method of making the product.

Figure 1:
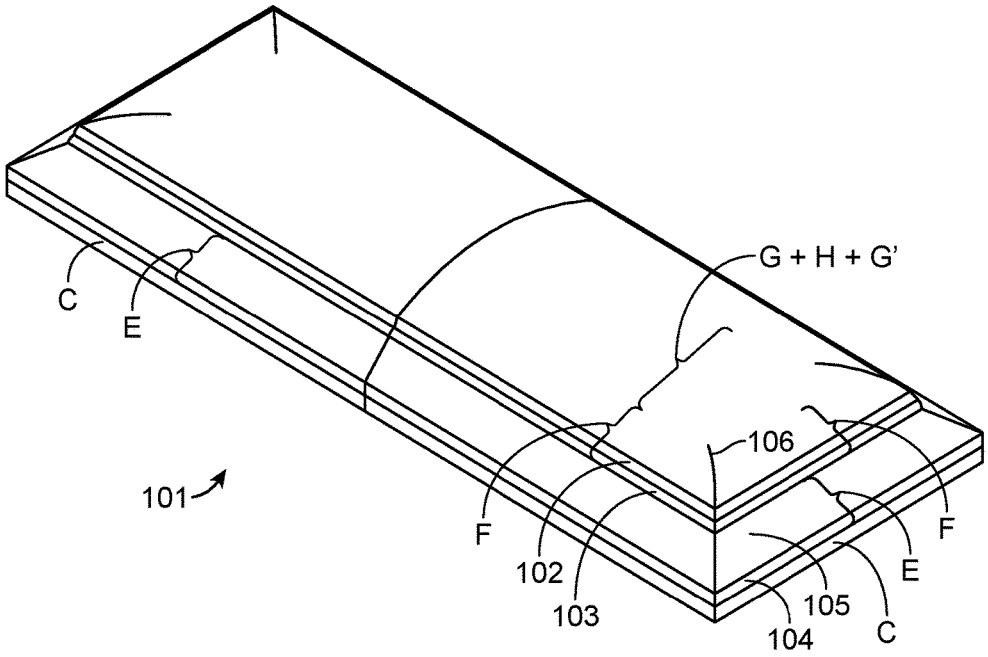
FIG. 1 is a perspective view of a round-top casket lid of the present invention.
Figure 2:
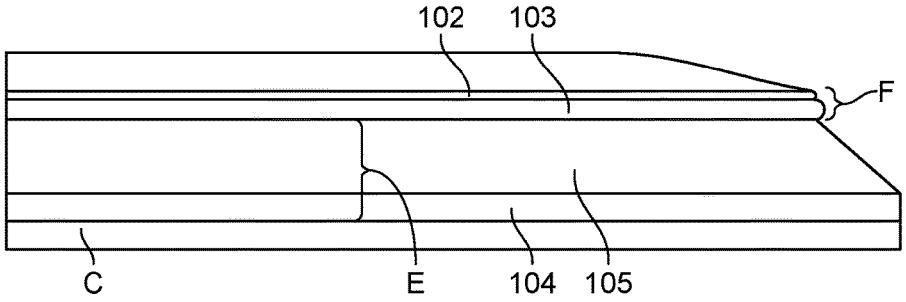
FIG. 2 is a front elevational view of a round-top casket lid of the present invention.
Figure 3:
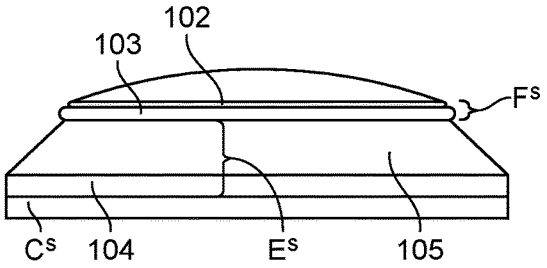
FIG. 3 is a side elevational view of a round-top casket lid of the present invention.
Figure 6:
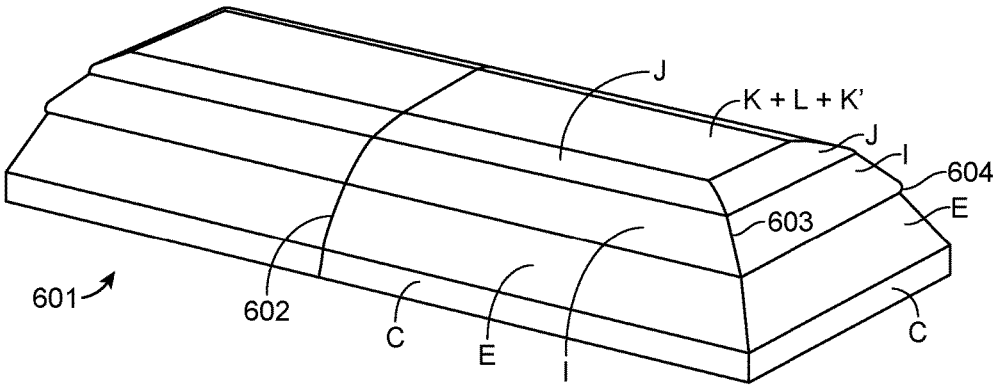
FIG. 6 is a perspective view of a flat-top casket lid of the present invention.
Figure 7:
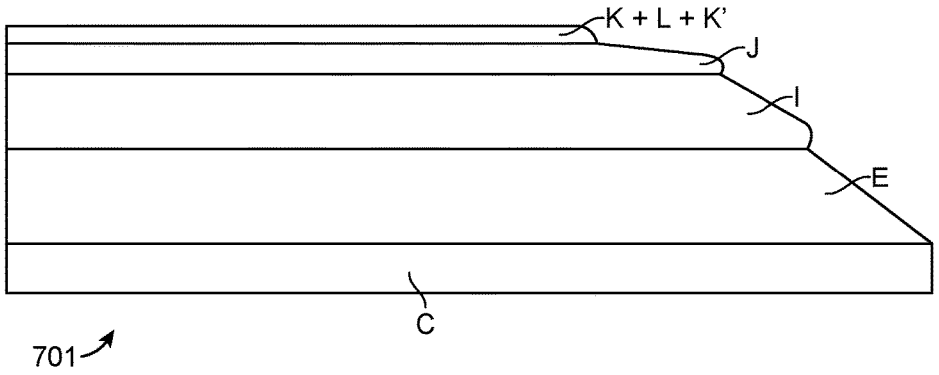
FIG. 7 is a front elevational view of a flat-top casket lid of the present invention.
Figure 8:
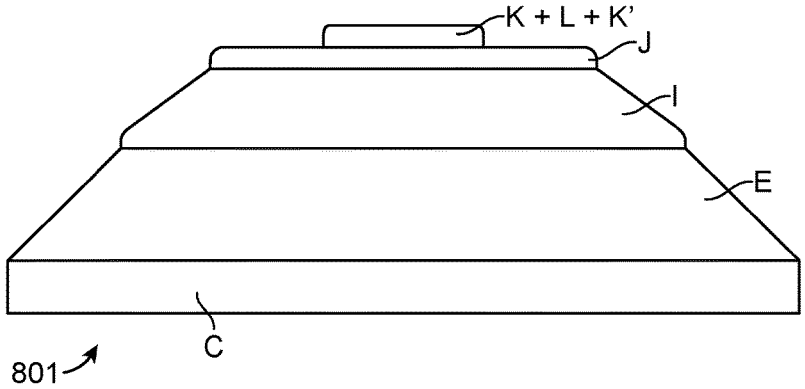
FIG. 8 is a side elevational view of a flat-top casket lid of the present invention.

Aspects of the present invention may be better understood in reference to the Figures. FIGS. 1 and 6 show perspective views of two different embodiments of the present invention. The casket lid portrayed in FIG. 1 is a round top lid whereas that portrayed in FIG. 6 is a flat top lid. Building a casket lid in accordance with either of these embodiments starts in the same manner and only varies at the point of assembling and attaching the top boards of the respective lids, i.e., Boards F-L, inclusive, with respect to the exemplified embodiments.

In preparation for manufacture of the casket lid embodiments exemplified herein, one first assembles inventory of the various boards employed. What follows is a chart of the specific boards used for the exemplified embodiments, keeping in mind that any routineer of the woodworking arts can achieve substantially the same appearance and functionality of the present invention using a different set of board descriptions, such as, for example, using lumber having greater or lesser depth or width or length. It is the overall combination of the various boards as instructed herein that results in the functionality and look of the casket lids of the present invention.

For further description of materials employed in manufacture of the exemplified embodiments of the present invention, note the following chart of boards used:

| Board Identifier[Note 1] | Board Category | Edge Dimensions[Note 2] | Length[Note 3] | For Which Embodiment | Special Cuts |
|---|---|---|---|---|---|
| A and A' | Support Board | ¾ × 1½ in. | As needed | Either | N/A |
| B and B' | Support Board | ¾ × 1½ in. | As needed | Either | N/A |
| C and C' | Side Board | 1½ × ¾ in. | As needed | Either | N/A |
| D and D' | Support Board | 1½ × 1½ in. | As needed | Either | Note 4 |
| E and E' | Side Board | ¾ × 6 in. | As needed | Either | Note 5 |
| F and F' | Top Board | ¾ × 4¾ in. | As needed | Round Top | Note 6 |
| G and G' | Top Board | ¾ × 4¾ in. | As needed | Round Top | Note 7 |
| H | Top Board | ¾ × 6¼in. | As needed | Round Top | Note 8 |
| I and I' | Side Board | ¾ × 4¼in. | As needed | Flat Top | Note 9 |
| J and J' | Top Board | ¾ × 4¼in. | As needed | Flat Top | Note 10 |
| K and K' | Top Board | ¾ × 3½ in. | As needed | Flat Top | Note 11 |
| L | Top Board | ¾ × 4½ in. | As needed | Flat Top | Note 12 |

Note 1: The exemplified embodiments of the present invention are substantially symmetrical across a longitudinal axis at the midpoint of the lid. Accordingly, support boards A, B, and D on one side of the casket lid has a counterpart support board A', B', and D' on the opposite side. The parallel long boards A and A', B and B', and D and D' are connected by two short boards at each end, thus forming rectangles. The same is true for each side board and top board, i.e., C and C', E and E', F and F', G and G', I and I', J and J', and K and K'. The sole exception is the center top board H or L (for the round top or flat top, respectively), of which there is only one per casket lid. Of course, one could split the center top board and join them to another board for decorative effect, for example; and, in certain embodiments, that is exactly the situation. In yet other embodiments, the outside surface of one or more of the side or top boards has a portion cut therefrom for insertion of an inlay, again for decorative effect.

Note 2: Edge dimensions are presented in a precise manner; however, each board has edge dimensions that approximate the listed dimensions in the chart. Variations from the stated dimensions should not be considered to place a casket lid having such variant dimensions of any of its boards as other than that which is described and claimed herein, meaning that such variant dimensions as may exist are part and parcel of the present invention as described and claimed. Accordingly, recital of particular dimensions are each considered approximate particularly owing to the fact that wood "breathes" in that wood will expand with increased humidity of summers and contract with decreased humidity of winters.

Note 3: The length of the boards needed for the casket lid are chosen depending on the size casket that is desired. If a casket is needed for a decedent who was six feet tall, then the board lengths for the long sides of the casket would preferably be about six and a half feet long; and for a taller or shorter decedent, appropriately longer or shorter as needed. Similarly, if the girth of the decedent is substantially larger than most, then the board lengths at the two ends of the casket would be affected in addition to the center top board and/or the center top board and its immediately adjacent top boards that may be desirably set to greater widths. Those skilled in the carpentering arts can adapt the description provided here to readily make such adjustments.

Figure 4:
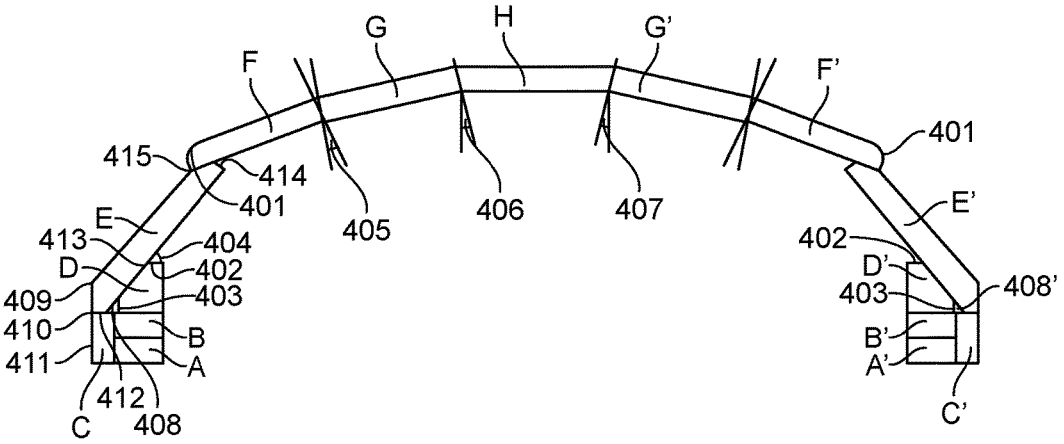
FIG. 4 is a cross-section view of a round-top casket lid of the present invention.
Figure 9:
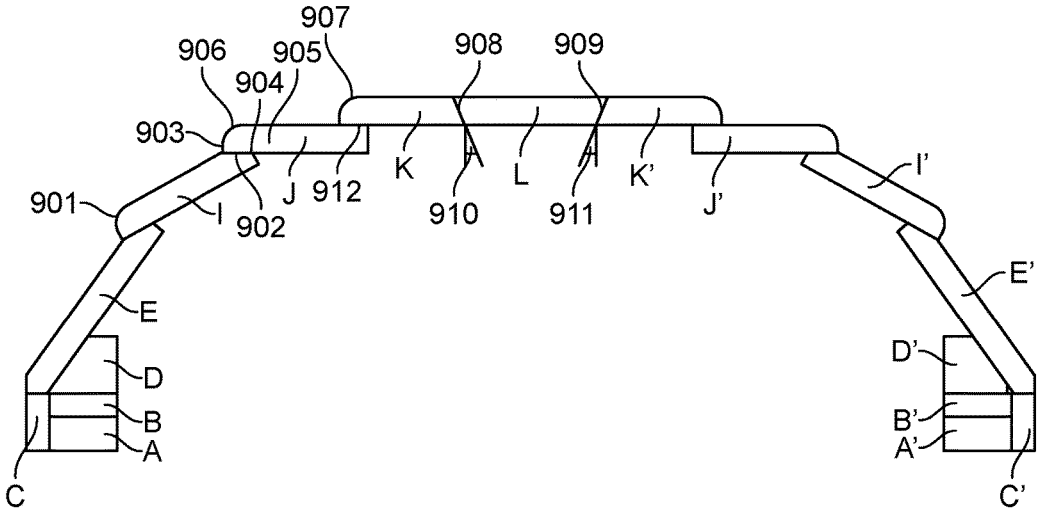
FIG. 9 is a cross-section view of a flat-top casket lid of the present invention.

Note 4: Making Board D or D' requires an additional cut ripped along the length of the board such that of the original perfect 1½ square edge dimension, about ¼ inch remains on one side 403 and about ¾ inch remains on its immediate orthoganol side 402 resulting in an approximately 35° angle 404 between the two points. FIG. 4 or 9 includes an illustration of the shape of the edge of Board D or D'.

More particularly, Board D or D' is generated using a 1½×1½ inch board. Using a standard table saw, the working edge of the table saw fence is secured approximately ½ inch away from the table saw blade; and then the table saw blade is tilted away from the fence to create an approximately 35° angle. The 1½×1½ inch board is then placed flat on the table saw and held firmly but gently along the fence while ripping the board.

Note 5: Making Board E or E' requires three additional cuts: At one end, an approximately 35° cut is made shaving off wood along a line between points 409 and 410 located at about ½ inch along the longer dimension of the edge and about midway along the shorter dimension of the edge, respectively, so that the cut edge forms along the plane formed by the outer edge 411 of Board C. For that edge to be coplanar there, the thus far untouched portion of the edge needs to be cut so that that portion sits on the plane formed by the upper edge 412 of Board C and the inside longer dimension 413 of Board E is coplanar with the cut edge on Board D. Lastly, the other shorter edge 414 of Board E is also shaved to form an about 30° angle between a point 415 about ½ inch from the shorter side of the edge along the longer side and about the midpoint on the shorter side of the edge, thus forming an angle between about 30° and 35°. FIG. 4 or 9 includes an illustration of the shape of the edge of Board E or E'.

More particularly, Board E or E' is generated from standard lumber of a desired width and thickness. In one embodiment, the thickness (or depth) is about ¾ inch; and the width is about six inches. Using a standard table saw, the working edge of the table saw fence is secured approximately ¼ inch away from the table saw blade; and the table saw blade is then tilted away from the fence so that the angle between the working edge of the fence and the table saw blade approximates 35°. The board is then placed on its ¾ inch edge of its length and held firmly but gently against the fence while ripping. The board is then flipped over to place its opposing side's ¾ inch edge against the fence, held in position firmly but gently while ripping the opposing side.

For cutting the angle that contacts Board C or C', the working edge of the table saw fence is moved to a position that is about ⅜ inch less than the board width away from the table saw blade; the table saw blade is then tilted approximately 35° away from the fence. The board is then placed flat on the table saw and held firmly but gently against the table saw fence while ripping.

Note 6: Making Board F or F' requires rounding one corner 401 that faces the outside of the casket and cutting the opposite side of the short dimension of the board so that it forms about a 12° to about a 15° angle 405 relative to the outer portion of the edge. The width of Board F or F' is per the desired width of the casket lid and, in one embodiment, is about 4¾ inches wide. One can use lumber of greater or lesser width depending upon what overall width is wanted for the casket lid. The depth of Board F or F' is per the desired depth of the boards used for the casket lid and, in one embodiment, is about ¾ inch deep. FIG. 4 includes an illustration of the shape of the edge of Board F or F'.

More particularly, Board F or F' is generated using standard lumber that is cut about ½ inch wider than the desired width. Using a standard table saw, the working edge of the table saw fence is set approximately ⅛ inch away from the table saw blade; and the table saw blade is tilted about 12° away from the working edge of the table saw fence. The board is then placed flat on the table saw, held firmly but gently against the fence while ripping.

To shape the outer edge of the opposite side 401 of Board F or F' (relative to the side having the approximate 12° to 15° edge), one uses a standard shaper or router and appropriate cutting bits. In this description, reference will be made to use of a shaper. One sets the shaper fence to the center of the appropriate shaper cutting bit. The shaper bit is then adjusted to the desired oval setting for effecting the oval cut 401 on Board F or F'.

Note 7: Making Board G or G' requires cuts on the two shorter sides along the length of the board such that the opposing sides of the edge describe an angle of about 12° at positions 405 and 406. FIG. 4 includes an illustration of the shape of the edge of Board G or G'.

More particularly, Board G or G' is generated using standard lumber that is cut about ½ inch wider than the desired width. Using a standard table saw, the working edge of the table saw fence is set approximately ⅛ inch away from the table saw blade; and the table saw blade is tilted about 12° away from the working edge of the table saw fence. The board is then placed flat on the table saw, held firmly but gently against the fence while ripping.

Note 8: Making Board H requires cuts on the two shorter sides along the length of the board such that the opposing sides of the edge describe an angle of about 12° at positions 406 and 407, oriented in opposing directions so that Board H serves as if a "keystone" on an arch. FIG. 4 includes an illustration of the shape of the edge of Board H.

More particularly, Board H is generated using standard lumber that is cut about one inch wider than the desired width. Using a standard table saw, the working edge of the table saw fence is set approximately ½ inch less than the board width away from the blade; and the table saw blade is tilted about 12° away from the working edge of the table saw fence. The board is then placed flat on the table saw, held firmly but gently against the fence while ripping.

The table saw fence is then placed about ⅛ inch less than the desired board width away from the blade. After that, the board is placed flat on the table saw, and held firmly but gently against the fence while ripping. The board is then crosscut with a miter saw where the miter saw blade is tilted approximately to a 12° angle. The desired length is measured and the crosscut is repeated on the opposing end.

Note 9: Making Board I or I' requires a cut 902 and a shape 901 at opposing ends. The shape 901 is performed precisely as set forth above with respect to Board F or F' regarding shape 401. At the other end, an approximately 30° cut is made shaving off wood along a line between points 903 and 904 located at about ½ inch along the longer dimension of the edge and about ⅔ along the shorter dimension of the edge, respectively, so that the cut edge forms along the plane formed by the inner edge 905 of Board J. FIG. 9 includes an illustration of the shape of the edge of Board I or I'.

More particularly, Board I or I' is generated using standard lumber that is cut to a desired width. To shape the outer edge at position 901, one can use a standard shaper and appropriate cutting bits. One sets the shaper fence to the center of the appropriate shaper cutting bit. The shaper bit is then adjusted to the desired oval setting for effecting the oval cut 901 on Board I or I'.

Using a standard table saw, the working edge of the table saw fence is set approximately ⅜ inch less away from the blade; and the table saw blade is tilted about 30° away from the working edge of the table saw fence. The opposite ¾ inch edge of the board (relative to the side that receives a shaped corner) is then placed on the table saw, and held firmly but gently against the fence while ripping.

Note 10: Making Board J or J' requires shaping one corner 906 of its edge into an oval, which is the same act as set forth above with respect to position 901 on Board I or I'. FIG. 9 includes an illustration of the shape of the edge of Board J or J'.

Note 11: Making Board K or K' requires shaping one corner 907 and creating at its opposing edge an angle 908. FIG. 9 includes an illustration of the shape of the edge of Board K or K'.

More particularly, Board K or K' is generated using standard lumber that is cut about ¾ inch greater than the desired board width. To shape the outer edge at position 907, one can use a standard shaper and appropriate cutting bits. One sets the shaper fence to the center of the appropriate shaper cutting bit. The shaper bit is then adjusted to the desired oval setting for effecting the oval cut 907 on Board I or I'.

Using a standard table saw, the working edge of the table saw fence is set approximately ⅛ inch less than the desired board width away from the blade; and the table saw blade is tilted about 15° away from the working edge of the table saw fence. The board is then placed flat on the table saw with rounded edge down and toward the fence, and held firmly but gently against the fence while ripping.

Note 12: Making Board L requires cuts at either side of its short edge, i.e., at positions 908 and 909, in order for the board to function as if a "keystone" for an arch. Accordingly, Board L is angled on either side of its short edge at angle 910 and angle 911, which are substantially the same angle in opposite directions and provides for the keystone function. FIG. 9 includes an illustration of the shape of the edge of Board L.

More particularly, Board L is generated using standard lumber that is cut about one inch wider than the desired width. Using a standard table saw, the working edge of the table saw fence is set approximately ½ inch less than the board width away from the blade; and the table saw blade is tilted about 15° to about 20° away from the working edge of the table saw fence. The board is then placed flat on the table saw, held firmly but gently against the fence while ripping.

The table saw fence is then placed about ⅛ inch less than the desired board width away from the blade. After that, the board is placed flat on the table saw, and held firmly but gently against the fence while ripping. The board is then crosscut with a miter saw where the miter saw blade is tilted approximately to a 15° to 20° angle. The desired length is measured and the crosscut is repeated on the opposing end.

Step by Step Manufacture of Round Top Lid.

In one embodiment of the present invention, the casket lid consists of 29 boards that are configured to form a round top, as set forth in FIGS. 1-4. There are other round top embodiments that include yet more boards. For example, in one alternative embodiment, a board having a contrasting grain or color, or a burl, is included between Boards H and G or F and G as a decorative element. In yet another alternative embodiment, one could increase the number of boards used by employing narrower boards that together approximate the width of one or more of Boards E, F, G, and/or H, for purposes of decorative effect or lack of availability of the appropriate width boards or both.

Apart from decorative effects, the length and width of the boards are determined by the overall size of the casket.

The boards of the casket lid are joined using standard methods of joining. For most joining, glue is employed in combination with a joining element, such as a wooden peg or a nail. In all cases, the nail or peg is driven in from the underside of the casket lid so that the joining element is not seen from the outside of the casket lid.

Figure 5:
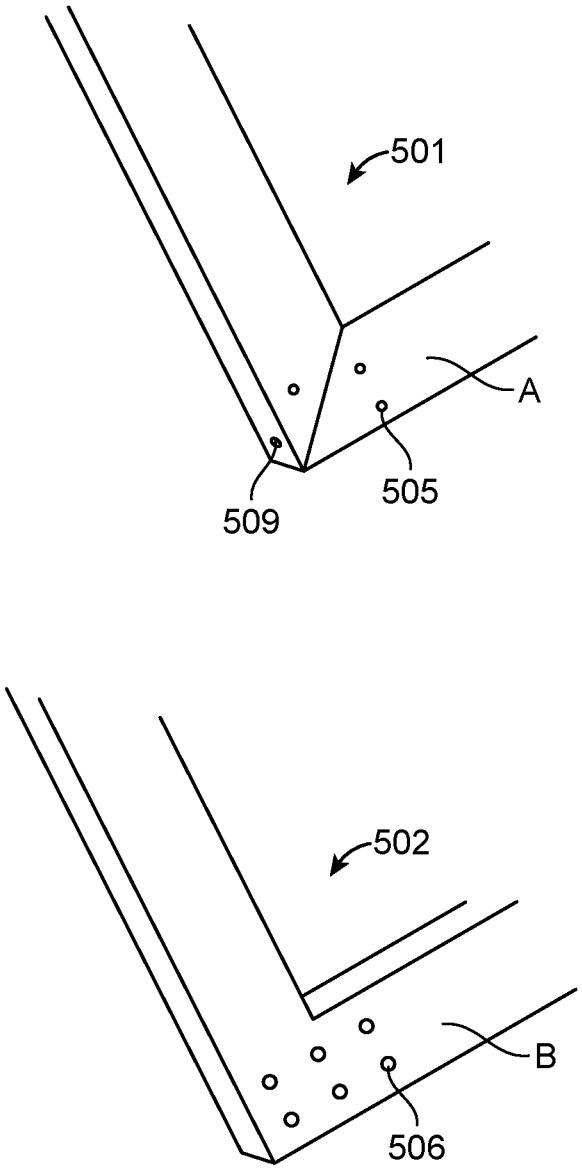
FIG. 5 illustrates four joining methods employed in the making of casket lids of the present invention.
Figure 5:
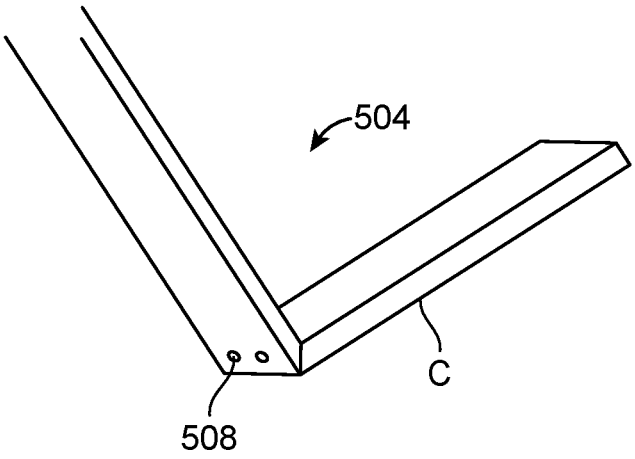
Figure 5:
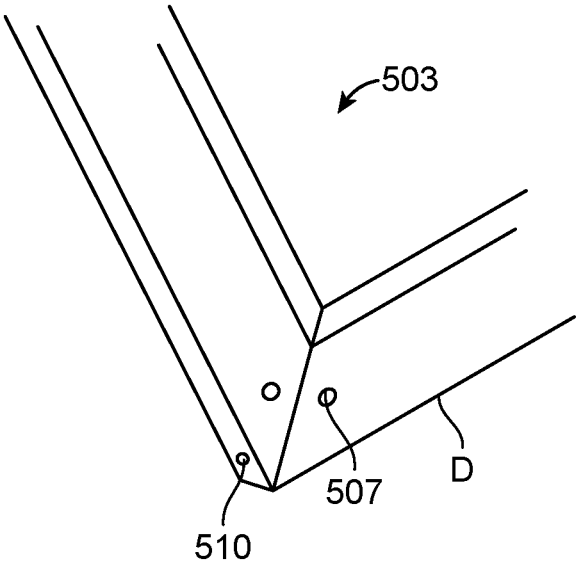

The method of making the casket lid 101 as shown in FIG. 1 starts with joining the four sides of Board A. Of course, Board A cannot be seen from the outside of the casket lid, but is clearly marked in the cross-section of the casket lid illustrated in FIG. 4. The four sides are joined using a suitable joint, such as a standard picture joint 501, at each corner, as illustrated in FIG. 5. This picture joint requires 45° mitered edges that are joined by glue along the diagonal. In addition, pegs or nails are inserted at positions 505 and 509, for example.

Board B is then added by attachment directly to the top of Board A, again using glue and pegs or nails. The four corners of Board B are joined using a suitable joint, such as a butt joint 502; secured, again, using glue and pegs or nails. The pegs or nails 506 are placed in various places to increase the strength of the support layers of the casket lid.

Board C is attached next, joining directly to Boards A and B on their respective outer edges. The four corners of Board C are joined using a suitable joint, such as a picture joint 504. The picture joint 504 is joined using glue and pegs or nails, as, for example, at position 508. The pegs or nails used to secure the picture joint 504 are the only joining elements observable from the outside of the casket lid.

Board D is then attached directly on top of Board B and joined at its four corners with suitable joints, such as picture joints 503. The picture joints are secured using glue at the diagonal and pegs or nails at positions 507 and 510, for example.

The joints used to secure the Support Boards A, B, and D are suitable to the extent that they marry the four sections of each support layer to each other. A key component of these joinings is the use of different joining methods on adjacent layers thereby minimizing the likelihood of separation of these joints. Accordingly, in the embodiment exemplified here: the first layer of Board A is joined using picture joints at its four corners; the second layer of Board B is joined using butt joints at its four corners; the third layer of Board D is joined using picture joints at its four corners. In an alternative embodiment, the boards of the first and third layers are joined using butt joints and the boards of the middle layer is joined using picture joints.

Board E is a side board that is attached to Boards C and D using glue and pegs or nails. The four corners of Board E are joined using a suitable joint, such as a picture joint or a butt joint; preferably with a picture joint. One can visualize the ¾ inch edge of Board E in FIG. 1 at position 104; and the width of Board E at position 105.

Board F is a top board that is attached to Board E using glue and peg or nail. The four corners of Board F are joined using a suitable joint, such as a picture frame as indicated in FIG. 1 at position 106. The oval shape included in Board F is represented in FIG. 1 at position 102 and the edge of the board is represented by position 103.

Board G attaches to Board F using glue and peg or nail. The four corners of Board G are joined using a suitable joint, such as a picture joint.

Finally, Board H is attached to Board G using glue.

After the glue has set thereby securing the boards of the casket lid, a standard belt and/or rotary sander is employed to smooth the joined edges of each of the top boards. The result is a round top casket lid.

Step by Step Manufacture of Flat Top Lid.

In one embodiment of the present invention, the casket lid consists of 33 boards that are configured to form a flat top, as set forth in FIGS. 6-9. There are other round top embodiments that include yet more boards. For example, in one alternative embodiment, a board having a contrasting grain or color, or a burl, is included between Boards L and K as a decorative element. In yet another alternative embodiment, one could increase the number of boards used by employing narrower boards that together approximate the width of one or more of Boards E, I, J, K and/or L, for purposes of decorative effect or lack of availability of the appropriate width boards or both.

The method of making set forth herein above with regard to joining generally and the support boards and side boards used for the round top casket lid are the same for manufacture of the flat top casket lid; and, therefore, apart from decorative effects, the length and width of the boards are determined by the overall size of the casket.

The boards of the casket lid are joined using standard methods of joining. For most joining, glue is employed in combination with a joining element, such as a wooden peg or a nail. In all cases, the nail or ped is driven in from the underside of the casket lid so that the joining element is not seen from the outside of the casket lid.

The method of making the casket lid 101 as shown in FIG. 1 starts with joining the four sides of Board A. Of course, Board A cannot be seen from the outside of the caeket lid, but is clearly marked in the cross-section of the casket lid illustrated in FIG. 4. The four sides are joined using a suitable joint, such as a standard picture joint 501, at each corner, as illustrated in FIG. 5. This picture joint requires 45° mitered edges that are joined by glue along the diagonal. In addition, pegs or nails are inserted at positions 505 and 509, for example.

Board B is then added by attachment directly to the top of Board A, again using glue and pegs or nails. The four corners of Board B are joined using a suitable joint, such as a butt joint 502; secured, again, using glue end pegs or nails. The pegs or nails 506 ere placed in various places to increase the strength of the support layers of the casket lid.

Board 9 is attached next, joining directly to Boards A and B on their respective outer edges. The four corners of Board C are joined using a suitable joint, such as a picture joint 504. The picture joint 504 is joined using glue and pegs or nails, as, for example, at position 508. The pegs or nails used to secure the picture joint 504 are the only joining elements observable from the outside of the casket lid.

Board D is then attached directly on top of Board Band joined at its four corners with suitale joints. Such as picture joints 503. The picture joints are secured using glue at the diagonal and pegs or nails at positions 507 and 510, for examgle.

The joints used to secure the Support Boards A, B, and D are suitable to the extent that they marry the four sections of each support layer to each other. A key component of these joinings is the use of different joining methods on adjacent layers thereby minimizing the likelihood of separation of these joints. Accordingly, in the embodiment exemplified here: the first layer of Board A is joined using picture joints at its four corners; the second layer of Board B is joined using butt joints at its four corners; the third layer of Board D is joined using picture joints at its four corners. In an alternative embodiment, the boards of the first and third layers are joined using butt joints and the boards of the middle layer is joined using picture joints. Board E is a side board that is attached to Boards C and D using glue and pegs or nails. The four corners of Board E are joined using a suitable joint, such as a picture joint or a butt joint; preferably with a picture joint.

One can visualize the ¾ inch edge of Board E in FIG. 1 at position 104; and the width of Board E at position 105.

Board I is a side board that is attached to Board E using glue and peg or nail. The four corners of Board I are joined using a suitable joint, such as a picture frame as indicated in FIG. 6 at position 603. The oval shape included in Board I is represented in FIG. 6 at position 604.

Board J attaches to Board I using glue and peg or nail along the common surface 902 shown in FIG. 9. The four corners of Board J are joined using a suitable joint, such as a picture joint.

Board K attaches to Board J using glue and peg or nail along the common surface 912 shown in FIG. 9. The four corners of Board K are joined using a suitable joint, such as a picture joint.

Finally, Board L is attached to Board K using glue.

Upon completion of the casket lid of any of the embodiments contemplated hereby, the casket lid can be cut into two pieces and separately hinged to the casket such that one can open part of the casket for viewing purposes.

While preferred embodiments of the present invention have been shown and described herein, it will be obvious to those skilled in the art that such embodiments are provided by way of example only. Numerous variations, changes, and substitutions will now occur to those skilled in the art without departing from the invention or the definitions provided herein for clearly recording inventor's conception and embodiments thereof. It should be understood that various alternatives to the embodiments of the invention described herein may be employed in practicing the invention.

It is intended that the following claims define the scope of the invention and that methods and structures within the scope of these claims and their equivalents be covered thereby.

What is claimed is:

1. A casket lid having two long sides and two short sides, comprising an internal support system and an external face, wherein (i) the internal support system comprises three layers that are each co-extensive with each of the long sides and short sides, (ii) the first layer and the third layer are each in contact with the second layer, (iii) each of said layers is in contact with the external face, and (iv) each layer includes four right angles formed by four boards of each said layer that are joined.

2. The casket lid of claim 1, wherein the first layer is not in contact with the third layer.

3. The casket lid of claim 2, wherein the four boards of each said layer are joined by a butt joint or a picture joint.

4. The casket lid of claim 3, wherein the three layers utilize both a butt joint and a picture joint.

5. The casket lid of claim 3, wherein each layer utilizes a butt joint or a picture joint but not both.

6. The casket lid of claim 3, wherein the second layer utilizes a butt joint.

7. The casket lid of claim 3, wherein the layers that are in contact are joined by a connecting means selected from the group consisting of glue, a peg, a nail, a screw, a rivet, and a strap.

8. The casket lid of claim 7, wherein the layers are joined by a combination of glue and a peg.

9. The casket lid of claim 8, wherein the external face is comprised of one or more side boards that are joined by glue.

10. The casket lid of claim 9, wherein the side boards are further joined by peg or nail.

11. The casket lid of claim 10, wherein the external face is comprised of a first top board that contacts one or more of the side boards.

12. The casket lid of claim 11, wherein the first top board is joined to an adjacent top board or top boards by glue.

13. The casket lid of claim 12, wherein the top board is rounded.

14. The casket lid of claim 12, wherein the top board is flat.

15. A method for making a casket lid that has two long sides and two short sides, an internal support system comprised of three layers, and an external face comprised of side boards and one or more top boards, and a longitudinal axis across which the casket lid displays substantial symmetry, comprising the steps of:

a. preparing boards specific for the internal support system, including two short boards and two long boards for each of the four sides for each layer of said internal support system;

b. preparing boards specific for the external face, including two short boards and two long boards for each of the four sides for each set of side boards or top boards, where each set of side boards or top boards forms a rectangle; however, the top board disposed along the longitudinal axis is a single board;

c. assembling a bottom-most layer of the internal support system by joining the short sides to the long sides thereof employing a picture joint at each corner, thereby resulting in a first rectangular structure;

d. assembling a second layer of the internal support system by joining the short sides to the long sides thereof employing a butt joint at each corner, thereby resulting in a second rectangular structure;

e. placing the second rectangular structure on top of the first rectangular structure and joining said structures employing glue and pegs, resulting in an intermediate internal support structure;

f. assembling a bottom-most side board of the external face by joining the short sides and long sides thereof to the respective short sides and long sides of the intermediate internal support structure employing glue in combination with pegs or nails; and employing picture joints at each corner of the bottom-most side board;

g. assembling a third layer of the internal support system by joining the short sides to the long sides thereof employing a picture joint at each corner, thereby resulting in a third rectangular structure;

h. placing the third rectangular structure on top of the second rectangular structure and joining said structures employing glue and pegs;

i. assembling a second side board of the external face, which second side board has a bottom edge and a top edge and an inside face and an outside face, and wherein the bottom edge thereof contacts and is joined to the top edge of the bottom-most side board and the inside face contacts and is joined to the third rectangular structure;

j. optionally assembling a third side board of the external face, which third side board has an inside face, an outside face, and a lower end and an upper end, wherein the inside face that is proximal to the lower end of the third side board contacts and is joined to a surface created by a cut between the top edge and outside face of the second side board, wherein said joining employs glue and peg or nail inserted from the inside face of the second side board into the third side board and the second side board is upper most unless the casket lid includes the third side board, in which case the third side board is upper most;

k. assembling a first set of top boards of the external face, wherein the first set of top boards contacts and is joined to a surface created by a cut between the top edge and outside face of the upper-most side board, wherein said joining employs glue and peg or nail inserted from the inside face of the upper-most side board into the first set of top boards;

l. assembling a second set of top boards of the external face, wherein the second set of top boards extend through the length of the casket lid and contacts and is joined to the first set of top boards by glue; and m. assembling the remaining top board of the top of the casket lid by placing it in contact with inside longitudinal surfaces of the second set of top boards, wherein the remaining top board and the second set of top boards are joined by glue, wherein the inside longitudinal surfaces of the second set of top boards are those disposed closest to the longitudinal axis of the casket lid.

16. A casket lid having two long sides and two short sides, comprising an internal support system and an external face, wherein (i) the internal support system comprises three layers and the external face comprises one or more side boards and one or more top boards, wherein further the three layers are each co-extensive with each of the long sides and short sides, (ii) the first layer and the third layer are each in contact with the second layer, (iii) each of said layers is in contact with the external face on each of said long sides and said short sides, and (iv) the internal support system has no contact with any of the one or more top boards.

17. The casket lid of claim 16, wherein each layer includes four right angles formed by four boards of each said layer that are joined by a butt joint or a picture joint.

18. The casket lid of claim 17, wherein the layers, the one or more side boards, and the one or more top boards that are in contact are joined by a connecting means selected from the group consisting of glue, a peg, a nail, a screw, a rivet, and a strap.

19. The casket lid of claim 18, wherein the layers, the one or more side boards, and the one or more top boards that are in contact are joined by glue.

20. The casket lid of claim 19, wherein the one or more top boards are rounded.

* * * * *